US007866007B2

(12) United States Patent
DeBerry et al.

(10) Patent No.: US 7,866,007 B2
(45) Date of Patent: Jan. 11, 2011

(54) RETAINED TENSION METAL LOCKING TIE WITH 360 DEGREE SEAL

(75) Inventors: Earl J. DeBerry, Joliet, IL (US); Scott K Benedict, New Lenox, IL (US); Bernard J O'Grady, New Lenox, IL (US)

(73) Assignee: Panduit Corp., Tinley Park, IL (US)

( * ) Notice: Subject to any disclaimer, the term of this patent is extended or adjusted under 35 U.S.C. 154(b) by 963 days.

(21) Appl. No.: 11/690,335

(22) Filed: Mar. 23, 2007

(65) Prior Publication Data

US 2007/0226963 A1 Oct. 4, 2007

Related U.S. Application Data

(60) Provisional application No. 60/786,796, filed on Mar. 28, 2006.

(51) Int. Cl.
*B65D 63/08* (2006.01)

(52) U.S. Cl. ..... 24/25; 24/20 R; 24/20 EE; 24/268

(58) Field of Classification Search ..... None
See application file for complete search history.

(56) References Cited

U.S. PATENT DOCUMENTS 1,690,643 A 11/1928 Lavender
4,015,311 A * 4/1977 Curtis ..... 24/23 R
4,286,361 A * 9/1981 MacKenzie ..... 24/276
4,399,592 A 8/1983 Chopp, Jr. et al.
4,399,593 A 8/1983 De Bradandere et al.
4,445,254 A * 5/1984 Allert ..... 24/274 R
4,473,925 A 10/1984 Jansen
4,528,730 A * 7/1985 Spaulding ..... 24/274 R
4,765,032 A 8/1988 Fortsch
4,868,953 A 9/1989 Fortsch
5,251,360 A 10/1993 Putz
5,533,235 A 7/1996 Fukuda
5,560,087 A * 10/1996 Marques ..... 24/274 R
5,687,457 A 11/1997 Hama
5,740,589 A 4/1998 Palau Dominguez
5,909,852 A * 6/1999 Allert ..... 24/279

(Continued)

FOREIGN PATENT DOCUMENTS

EP 1384929 A1 1/2004

(Continued)

*Primary Examiner*—Jack W. Lavinder
(74) *Attorney, Agent, or Firm*—Robert A. McCann; Christopher S. Clancy; Aimee E. McVady

(57) ABSTRACT

A cable tie is disclosed. The cable tie includes a strap with an extended tab and a locking head secured to the strap. The locking head has a top and a bottom. The bottom of the locking head includes at least one relief slot that enables the locking head to deform when the cable tie is installed around a bundle of objects. The bottom of the locking head also includes at least one tab that extends away from the locking head. The extended tab of the strap, the at least one front tab of the locking head and the at least one relief slot in the bottom of the deforming locking head enable the cable tie to provide a 360 degree seal around the bundle of objects.

4 Claims, 4 Drawing Sheets

U.S. PATENT DOCUMENTS 6,076,235 A * 6/2000 Khokhar ..... 24/25
6,230,369 B1 5/2001 Steadman
6,449,813 B2 * 9/2002 Keller et al. ..... 24/274 R
6,647,596 B1 11/2003 Caveney
6,668,427 B2 12/2003 Bulanda et al.
7,024,731 B2 4/2006 Craig, Jr.
7,093,326 B2 8/2006 Oetiker

FOREIGN PATENT DOCUMENTS

JP 2003314771 A * 11/2003

* cited by examiner

RETAINED TENSION METAL LOCKING TIE WITH 360 DEGREE SEAL

CROSS-REFERENCE TO RELATED APPLICATIONS

This application claims priority to Provisional Patent Application No. 60/786,796, filed Mar. 28, 2006.

FIELD OF THE INVENTION

The present invention relates to a cable tie, and more particularly, to a metal locking tie that provides a 360-degree seal around a bundle of objects.

BACKGROUND OF THE INVENTION

Metallic bundling devices incorporating locking balls and roller pins have been used for bundling bales of cotton or the like since the Nineteenth Century. None of the prior art devices were positive locking, i.e. depending on the orientation of the locking head, gravity could hold the ball out of locking engagement with the strap resulting in release. U.S. Pat. No. 4,399,592 addressed this problem by teaching the addition of a raised portion or protuberance for deflecting the threaded strap away from the floor as the threaded strap exits the locking head. This deflection ensures that the locking ball is in continuous engagement with the threaded strap regardless of the position of the ball or the orientation of the locking head. Although the threaded strap is secured in the locking head, there are gaps between the strap and the bundle of objects.

Thus, it would be desirable to provide a cable tie that is capable of providing an improved 360-degree seal around a bundle of objects.

SUMMARY

A metal locking tie is disclosed. The cable tie includes an elongate metallic strap or body with an extended tab and a metallic locking head secured to the strap. The locking head includes a top and a bottom. The bottom of the locking head has a plurality of relief slots. The relief slots enable the locking head to deform when the cable tie is installed around a bundle of objects. The locking head also includes at least one tab extending from the bottom of the locking head. The extended tab of the strap, the at least one front tab of the locking head and the relief slots in the bottom of the locking head enable the metal locking tie to provide a 360 degree seal around a bundle of objects.

DETAILED DESCRIPTION

Figure 1:
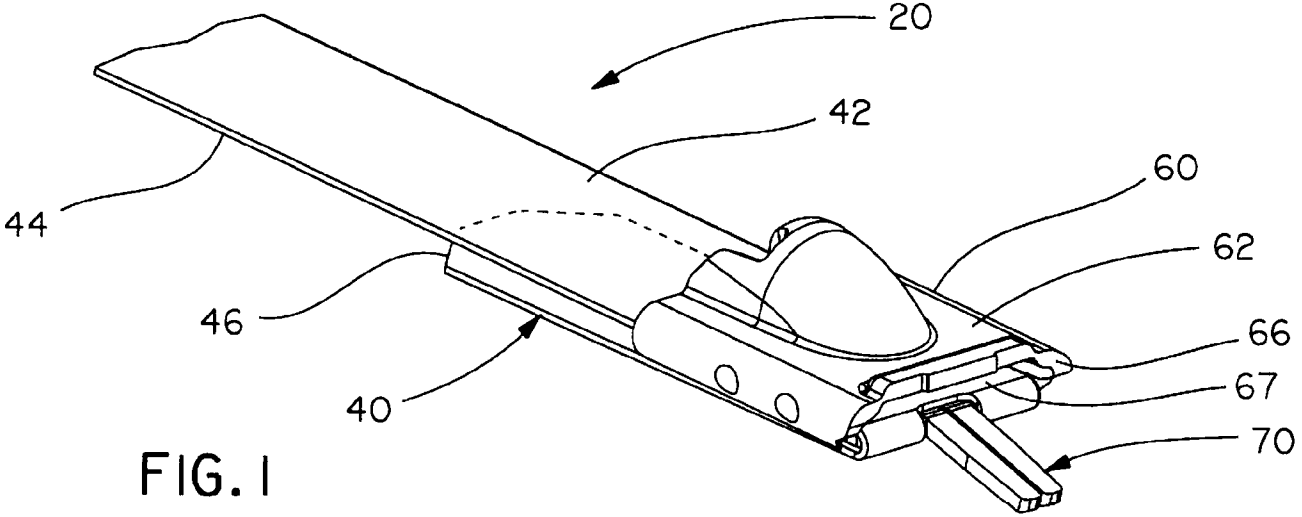
FIG. 1 is a perspective view of the metal locking tie of the present invention.
Figure 2:
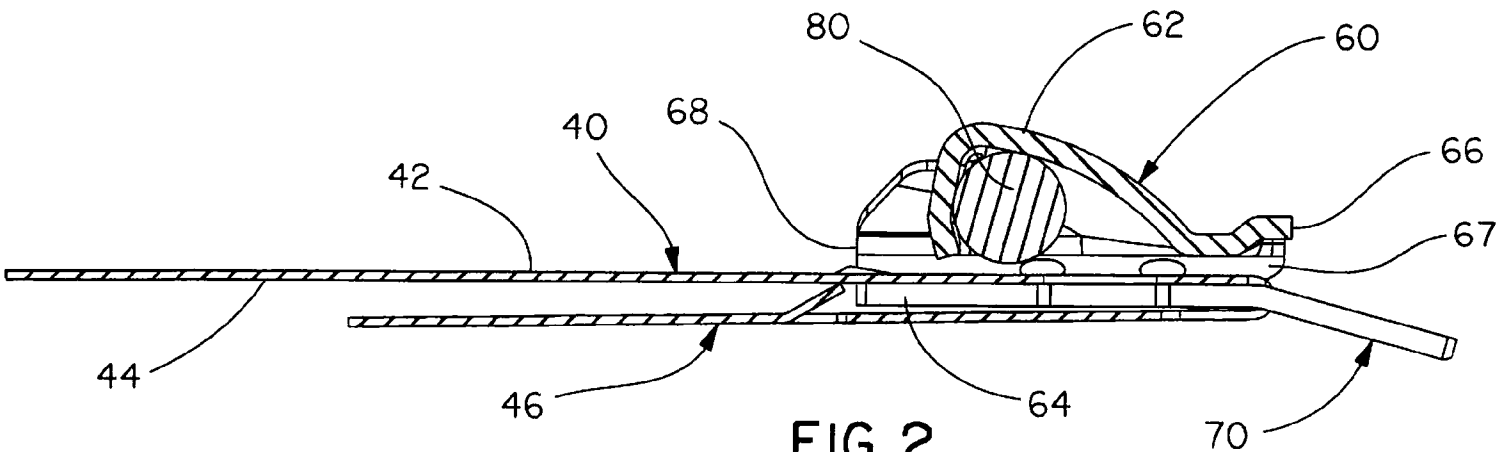
FIG. 2 is a side cross sectional view of the metal locking tie of FIG. 1.
Figure 3:
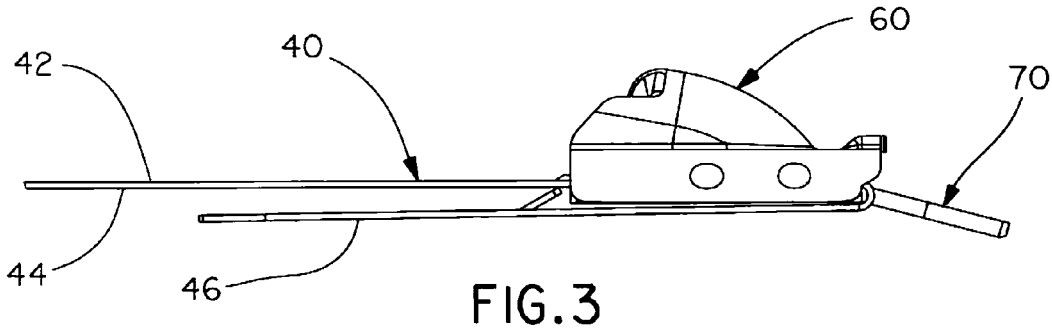
FIG. 3 is a side view of the metal locking tie of FIG. 1.

FIG. 1 illustrates the metal locking tie 20 of the present invention. The metal locking tie 20 includes a metal locking tie strap or body 40 and a metal locking tie head 60. As illustrated in FIGS. 1-6, the metal locking tie body 40 includes a top 42, a bottom 44 and an extra long or extended body tab 46. When the tie body 40 is installed in the tie head 60, the extra long body tab 46 extends along the bottom 64 of the tie head 60 covering the bottom 64 of the tie head 60. As illustrated in FIGS. 1-3, the extra long body tab 46 also extends beyond the tie head 60 such that the extra long body tab 46 is positioned beneath a portion of the tie body 40. As discussed below with respect to FIG. 9, when the metal locking tie 20 is installed around a bundle of objects 100, the extra long body tab 46 contacts a portion of the outer surface 102 of the bundle of objects 100.

Figure 4:
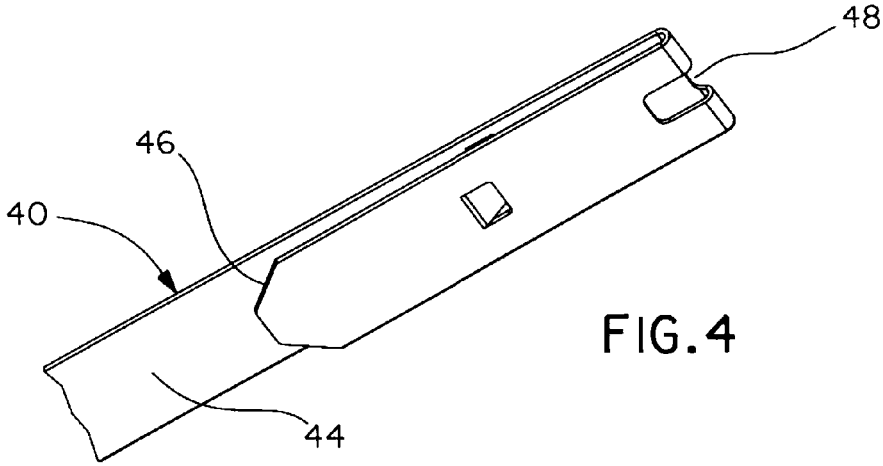
FIG. 4 is a partial perspective view of the bottom of the metal locking tie body of the metal locking tie of FIG. 1.
Figure 5:
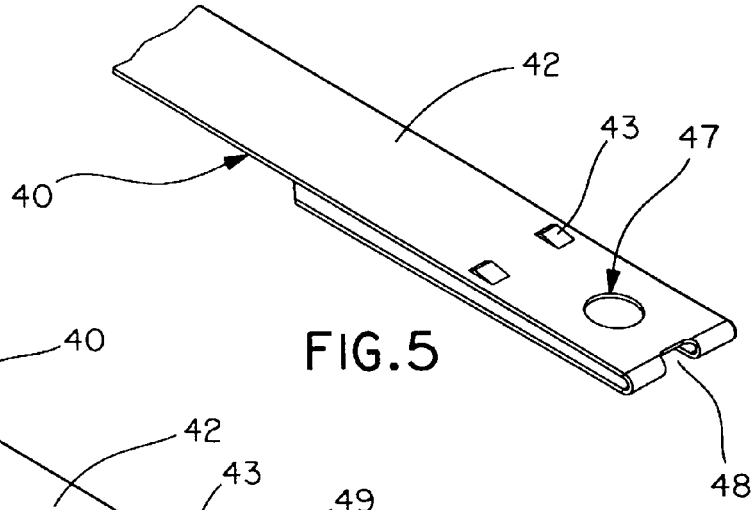
FIG. 5 is a partial perspective view of the top of the metal locking tie body of the metal locking tie of FIG. 1.

As shown in FIGS. 4 and 5, the tie body 40 includes a displacement aperture 47 and an engagement slot 48. The displacement aperture 47 is located in the center of the top 42 of the tie body 40 as illustrated and described in commonly owned U.S. Pat. No. 6,647,596, herein incorporated by reference. The engagement slot 48 is located in front of the displacement aperture 47. The engagement slot 48 wraps around the front of the tie body 40 toward the extra long body tab 46.

Figure 6:
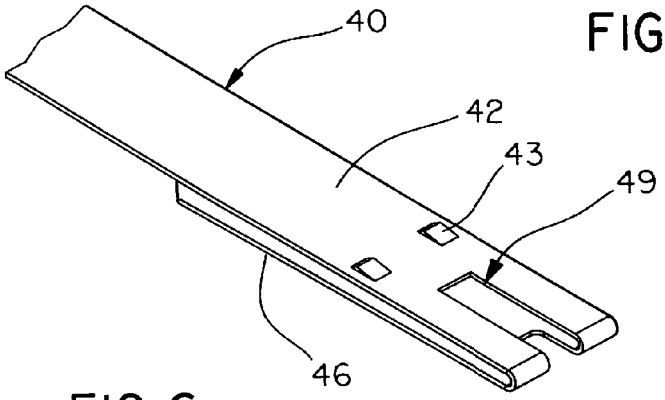
FIG. 6 is a partial perspective view of the top of an alternative metal locking tie body of the metal locking tie of FIG. 1.
Figure 7:
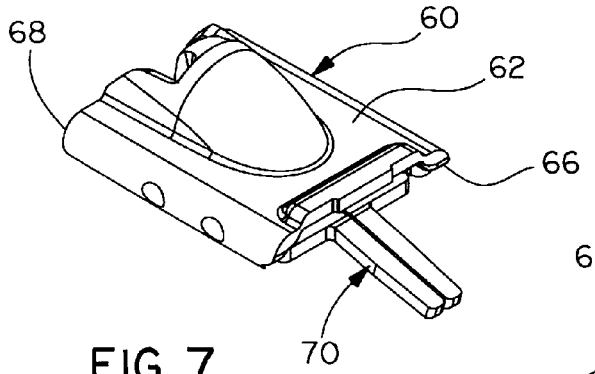
FIG. 7 is a perspective view of the top of the metal locking tie head of the metal locking tie of FIG. 1.
Figure 8:
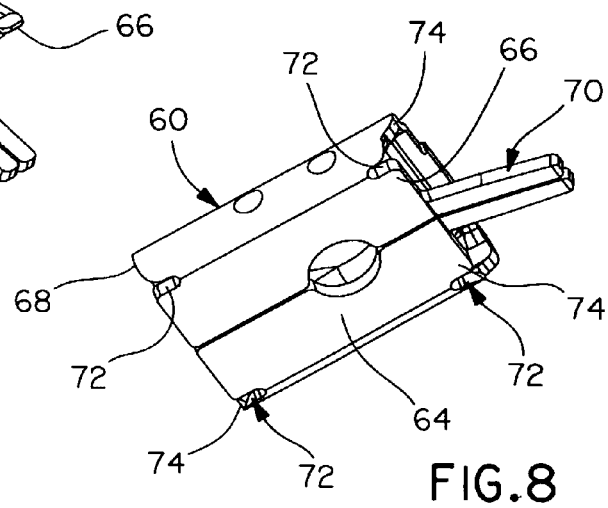
FIG. 8 is a perspective view of the bottom of the metal locking tie head of the metal locking tie of FIG. 1.

Alternatively, the tie body 40 may include a displacement slot 49 (see FIG. 6). The displacement slot 49 is located in the center of the top 42 of the tie body 40. The displacement slot 49 can be used as a displacement lock feature for securing the tie body 40 to the tie head 60.

The tie body 40 also includes ramps 43 located on the top 42 of the tie body 40 as illustrated and described in commonly owned U.S. Provisional Patent Application No. 60/886,552, herein incorporated by reference.

As illustrated in FIGS. 1-3, 7, and 8, the metal locking tie head 60 includes a top 62, a bottom 64, a strap entrance end or front portion 66, a strap exit end or a back portion 68, and a strap receiving aperture 67 extending therebetween. The metal locking tie head 60 also includes a typical locking ball 80 that enables the tie body 40 to be locked with respect to the tie head 60. FIGS. 1-3, 7, and 8 further illustrate the metal locking tie head 60 with a pair of long front tabs 70. The long front tabs 70 extend outwards from the bottom 64 of the tie head 60. The long front tabs 70 extend through the engagement slot 48 when the tie body 40 is installed in the tie head 60. Alternatively, if the tie body 40 includes a displacement slot 49, the long front tabs 70 would extend through the displacement slot 49 when the tie body 40 is installed in the tie head 60.

Figure 9:
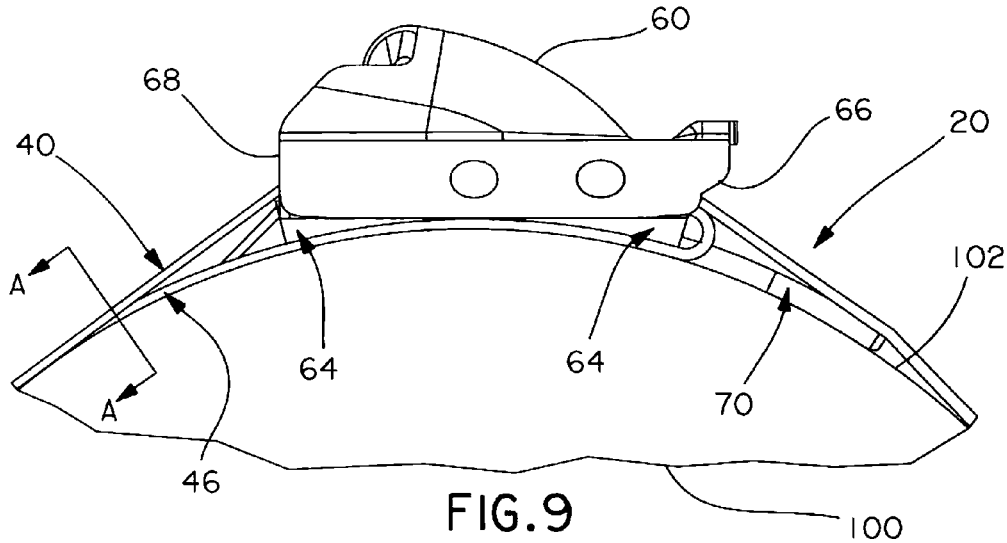
FIG. 9 is a partial side view of the metal locking tie of FIG. 1 installed around a bundle of objects.

The tie head 60 also includes a plurality of relief slots 72. The relief slots 72 are located at each corner 74 of the bottom 64 of the tie head 60. The relief slots 72 extend from the front portion 66 and the back portion 68 of the tie head 60 toward the center of the tie head 60. The relief slots 72 enable the front portion 66 and back portion 68 of the tie head 60 to deform when the metal locking tie 20 is installed around a bundle of objects 100. Thus, as illustrated in FIG. 9, the tie head 60 is able to conform to the outer surface 102 of the bundle of objects 100 when the metal locking tie 20 is under a tensile load.

Figure 10:
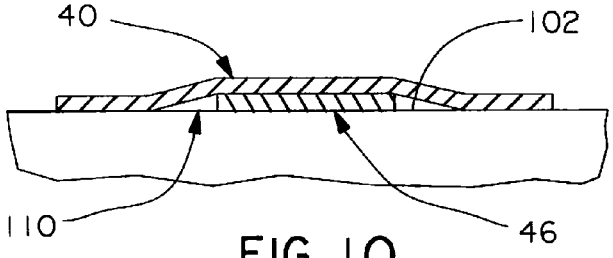
FIG. 10 is a cross sectional view of the metal locking tie of FIG. 9 taken along line A-A.

FIG. 10 illustrates a cross section of the extra long body tab 46 of the tie body 40 when the metal locking tie 20 is installed around a bundle of objects 100. The extra long body tab 46 reduces the gap 110 between the metal locking tie 20 and the outer surface 102 of the bundle of objects 100. Thus, the extra long body tab 46, the long front tabs 70 and the relief slots 72 in the bottom 64 of the tie head 60 enable the metal locking tie 20 to provide a 360 degree seal around a bundle of objects.

Figure 11:
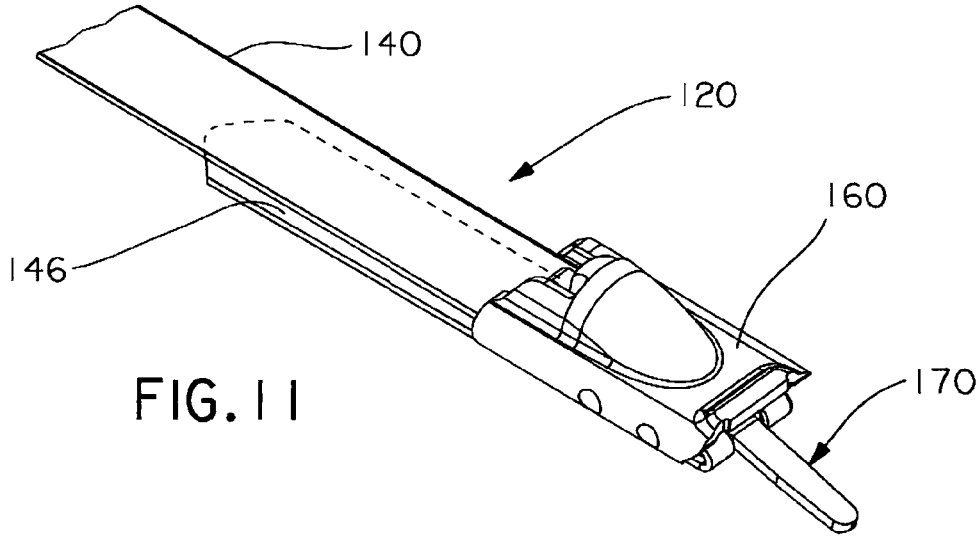
FIG. 11 is a perspective view of an alternative embodiment of the metal locking tie of the present invention.
Figure 12:
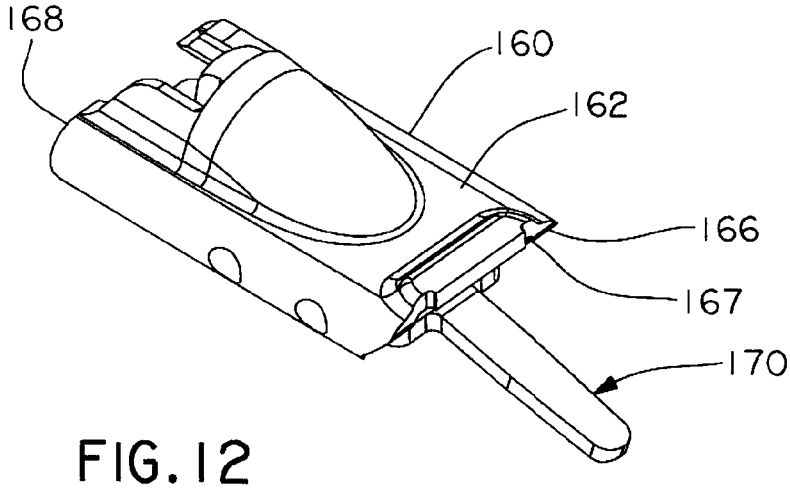
FIG. 12 is a perspective view of the top of the metal locking tie head of the metal locking tie of FIG. 11.
Figure 13:
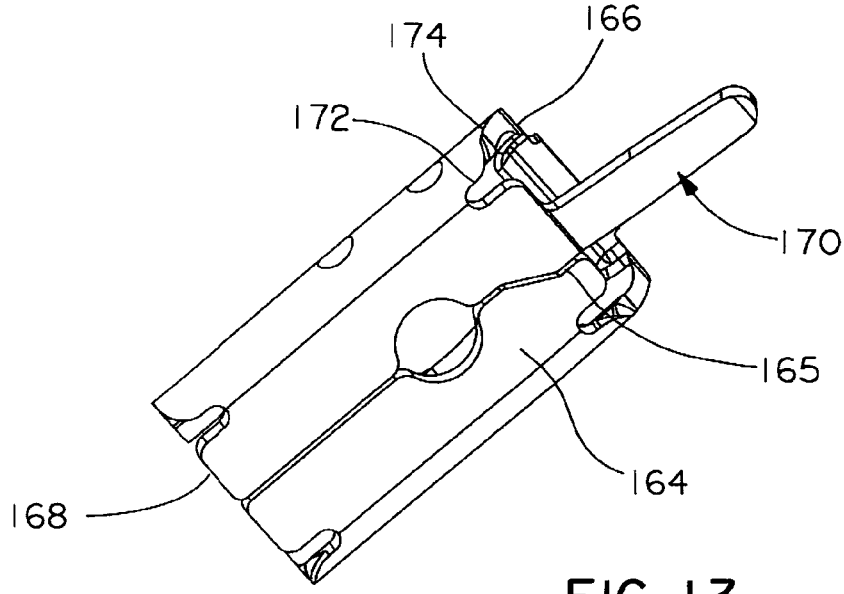
FIG. 13 is a perspective view of the bottom of the metal locking tie head of the metal locking tie of FIG. 11.

FIGS. 11-13 illustrate an alternative embodiment of the metal locking tie 120. The metal locking tie 120 includes a tie strap or body 140 and a metal locking tie head 160. The tie body 140 includes an extra long or extended body tab 146 identical to the extra long body tab 46 of tie body 40 described above with respect to FIGS. 1-10. Additionally, similar to the tie body 40 illustrated in FIGS. 5 and 6, the tie body 140 also includes a displacement aperture and an engagement slot or a displacement slot (not illustrated).

The metal locking tie head 160 includes a top 162, a bottom 164, a strap entrance end or a front portion 166, a strap exit end or a back portion 168, and a strap receiving aperture 167 extending therebetween. The metal locking tie head 160 also includes a single long front tab 170. The single long front tab 170 extends outward from the bottom 164 of the tie head 160. As illustrated in FIG. 13, the bottom 164 of the metal locking tie head 164 includes a stepped seam 165 for accommodating the single long front tab 170. Thus, when the metal locking tie 120 is assembled, the long front tab 170 extends through the engagement slot or the displacement slot when the tie body 140 is installed in the tie head 160.

Similar to the tie head 60 discussed above, the tie head 160 also includes a plurality of relief slots 172. The relief slots 172 are located at each corner 174 of the bottom 164 of the tie head 160. The relief slots 172 extend from the front portion 166 and the back portion 168 of the tie head 160 toward the center of the tie head 160. The relief slots 172 enable the front portion 166 and back portion 168 of the tie head 160 to deform when the metal locking tie 120 is installed around a bundle of objects 100.

As a result, the long body tab 146, the long front tab 170 and the relief slots 172 in the bottom 164 of the tie head 160 enable the metal locking tie 120 to provide a 360 degree seal when the metal locking tie 120 is installed around a bundle of objects 100.

Furthermore, while the particular preferred embodiments of the present invention have been shown and described, it will be obvious to those skilled in the art that changes and modifications may be made without departing from the teaching of the invention. The matter set forth in the foregoing description and accompanying drawings is offered by way of illustration only and not as limitation. The actual scope of the invention is intended to be defined in the following claims when viewed in their proper perspective based on the prior art.

The invention claimed is:

1. A cable tie, comprising:

an elongate metallic strap, wherein the strap includes an extended tab; and a metallic locking head secured to the strap, the locking head having a top, a bottom, a first side and a second side, wherein the bottom of the locking head having at least one relief slot for enabling the locking head to deform when the cable tie is installed around a bundle of objects;

wherein the at least one relief slot is located at a corner of the locking head between the bottom and the first side;

wherein the extended tab extends through the locking head, wraps around a front portion of the locking head and passes along and beyond the bottom of the locking head.

2. The cable tie of claim 1, wherein the locking head includes at least one tab extending from the bottom of the locking head.

3. The cable tie of claim 2, wherein the at least one tab of the locking head includes a single front tab.

4. The cable tie of claim 2, wherein the at least one tab of the locking head includes a pair of front tabs.

* * * * *